United States Patent [19]

Turra et al.

[11] Patent Number: 4,922,090

[45] Date of Patent: May 1, 1990

[54] DEVICE FOR CHECKING CONDITIONS OF A STRIP OF WRAPPING MATERIAL TO A USER MACHINE

[75] Inventors: Mario Turra; Armando Neri, both of Bologna, Italy

[73] Assignee: G.D. S.p.A., Bologna, Italy

[21] Appl. No.: 280,788

[22] Filed: Dec. 7, 1988

[30] Foreign Application Priority Data

Dec. 15, 1987 [IT] Italy ..... 3729 A/87

[51] Int. Cl.[5] ..... G01J 1/32; G01N 21/86

[52] U.S. Cl. ..... 250/205; 250/561

[58] Field of Search ..... 250/561, 562, 571, 572, 250/563, 205; 356/429, 430; 131/905, 906

[56] References Cited

U.S. PATENT DOCUMENTS

| | | | |
|---|---|---|---|
| 3,812,372 | 5/1974 | Wirtz et al. | 250/561 |
| 3,931,513 | 1/1976 | Germain | 250/561 |
| 4,488,808 | 12/1984 | Kato | 250/556 |
| 4,721,850 | 1/1988 | Sakai et al. | 250/201 |
| 4,724,481 | 2/1988 | Nishioka | 356/237 |
| 4,743,749 | 5/1988 | Grundy | 250/561 |
| 4,752,897 | 6/1988 | Zoeller et al. | 250/563 |

*Primary Examiner*—David C. Nelms
*Assistant Examiner*—Michael Messinger
*Attorney, Agent, or Firm*—Guido Modiano; Albert Josif

[57] ABSTRACT

The device for checking the feed conditions of a strip of wrapping material comprises a photodiode and a phototransistor arranged on opposite sides of the strip. A circuit block including a negative feedback is connected between the phototransistor and the photodiode to cause the phototransistor to work in a linear manner. The circuit block comprises an amplifier for amplifying the output signal of phototransistor to feed a check signal to the photodiode and to obtain from said photodiode a signal indicating anomaly conditions in the feed of the strip.

9 Claims, 2 Drawing Sheets

DEVICE FOR CHECKING CONDITIONS OF A STRIP OF WRAPPING MATERIAL TO A USER MACHINE

BACKGROUND OF THE INVENTION

The present invention relates to a device for checking the conditions of the feed of a strip of wrapping material to a user machine, and more in particular it relates to an apparatus for feeding a strip of cigarette paper in a cigarette manufacturing machine.

As known, the checking devices of these machines are capable of detecting interruptions in the feed, e.g. as a consequence of the breakage of the paper strip, using a light-emitting element arranged to one side of the strip and a light-detecting element arranged to the opposite side; depending on the intensity of the light reaching the detector element, constituted e.g. by a phototransistor, the latter either conducts or is switched off, so as to provide information regarding any breakage of the strip.

It is therefore sufficient to check whether current flows in the output circuit of the phototransistor to acquire information about the presence or absence of the strip.

There are also other checking devices which are capable of detecting incorrect feed conditions, such as e.g. portions of tape having an irregular thickness as a consequence of a splicing of the terminal portion of a strip unwound from an almost empty reel with the initial portion of a strip unwound from a new reel.

Regarding the detection of such splices between the two strips, arising from reel changing operations, such splices area also detected by similar optical devices in order to be eliminated; the passage of a spliced portion at a checking device in fact completely cuts off the beam of light which filters through the paper strip in normal operating conditions.

In the known art, the above described optical detection devices are used in practice in the two alternative conducting and switched off conditions in order to maximize their reliability.

This however entails the use of separate checking devices to detect different conditions of anomalies in strip feed, and the sensitivity of the detector elements may furthermore vary as the local lighting conditions vary.

SUMMARY OF THE INVENTION

The aim of the present invention is to provide a single checking device which is capable of detecting the various anomalies, including interruptions in the feed of the strip of wrapping material due to breakages or to depletion of the reel, and regions of splicing of two strips due to the replacement of a depleted reel with a new reel, with maximum reliability.

An object of the present invention is to provide a device of the above described type which is capable of performing a self-diagnostics operation for the malfunctions of its components.

The above-mentioned aim and objects, and other objects which will become apparent hereinafter, are achieved by a device for checking the feed conditions of a strip of wrapping material to a user machine as defined in claim 1.

The present invention provides a device for checking the feed conditions of a strip of wrapping material, characterized in that it comprises light-emitting means and means for detecting the emitted light, arranged on opposite sides of said strip, circuit means adapted to make said detector means operate in a linear manner, by generating an output signal which is proportional to the detected light, said circuit means comprising means for amplifying said output signal, to provide a check signal to said light-emitting means and to obtain a signal indicating anomaly conditions in the feed of said strip.

BRIEF DESCRIPTION OF THE DRAWINGS

The invention is now described with reference to the accompanying drawings, which illustrate a preferred but nonlimitative embodiment, wherein.

DESCRIPTION OF THE PREFERRED EMBODIMENTS

Figure 1:
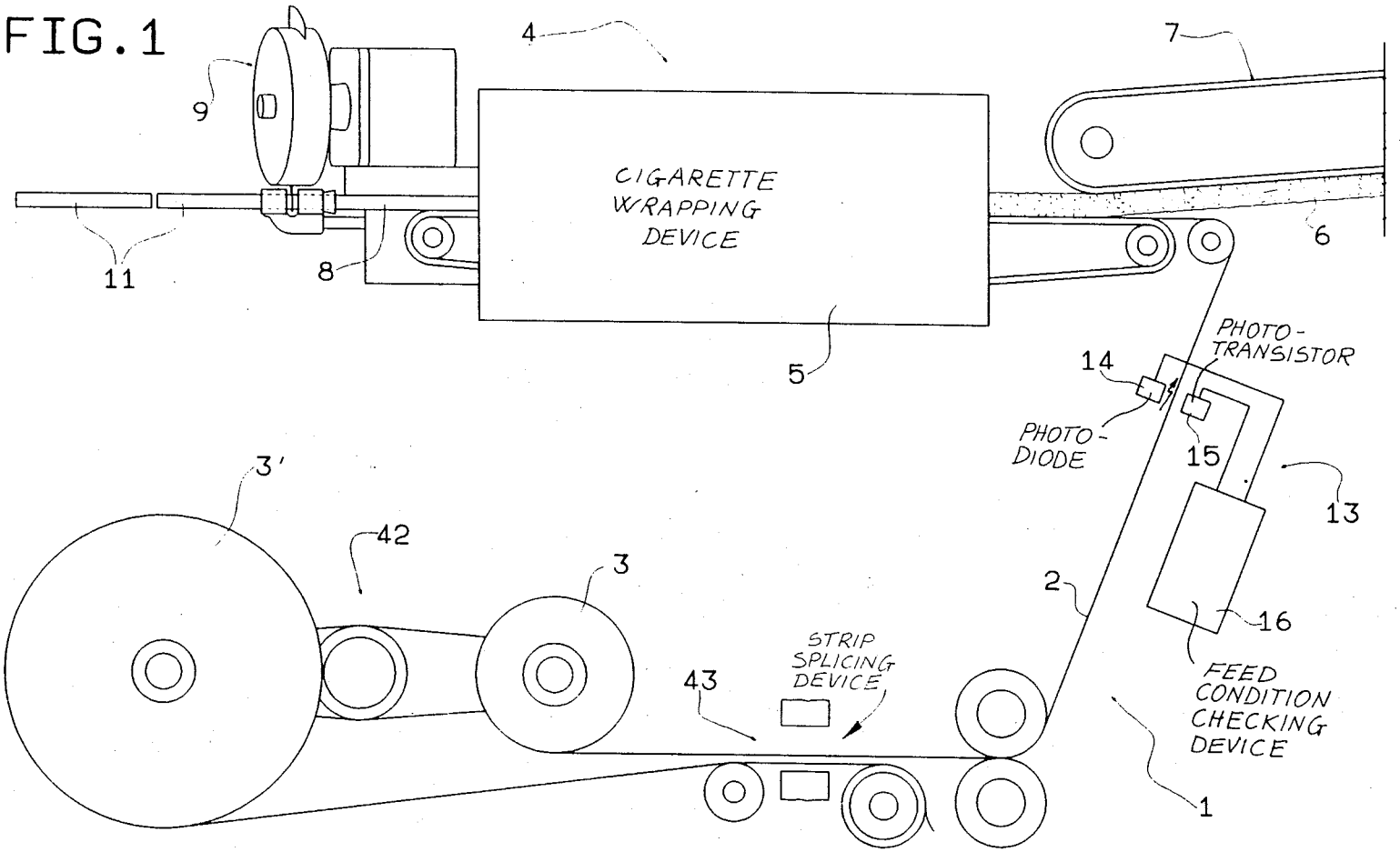
FIG. 1 is a schematic view of a cigarette manufacturing machine comprising the checking device according to the present invention.

With reference to FIG. 1, the reference numeral 1 generally indicates an apparatus for feeding a strip of wrapping material 2, unwound from a reel 3 and fed, through known reel-changing and splicing devices, respectively 42 and 43, to a user machine constituted by a cigarette manufacturing machine 4.

Said machine 4 comprises a device 5 for wrapping a continuous strip or line of tobacco 6 which is fed by conveyor means 7 within the strip of wrapping material 2 so as to form a continuous cigarette 8 which is divided into individual cigarettes 11 by a rotary-blade device 9.

The reference numeral 13 generally indicates a device for checking the feed conditions of the strip 2 to the machine 4.

Said device 13 comprises a light-emitting element 14 arranged to one side of the strip 2 and a light-detecting element 15 arranged on the opposite side. both connected to circuit block 16.

Figure 2:
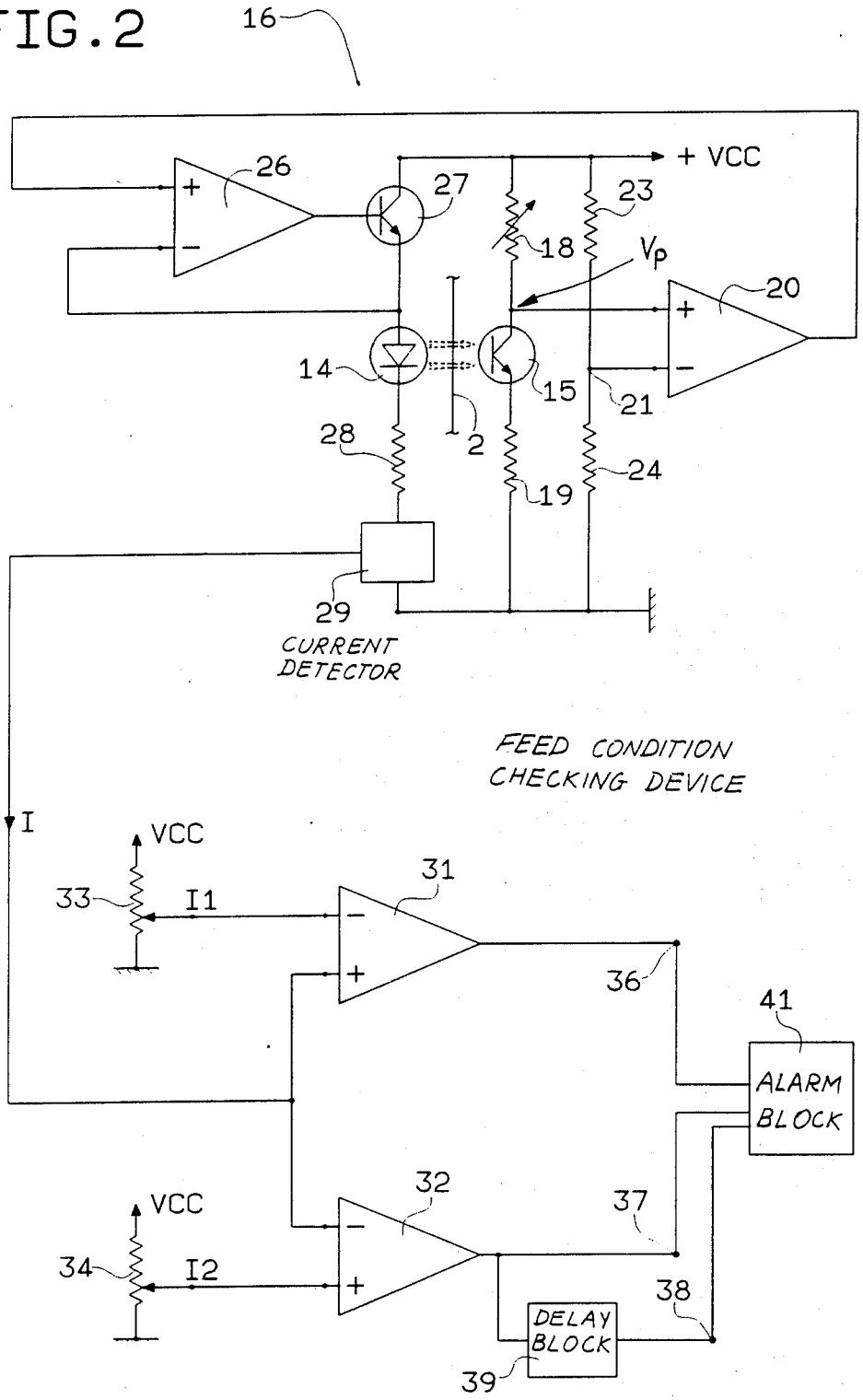
FIG. 2 is a view of the electric circuit of the checking device of FIG. 1.

With reference also to FIG. 2, the light-emitting element 14 is constituted by a photodiode, while the detecting element 15 is constituted by a phototransistor. The collector of the phototransistor 15 is connected through a potentiometer 18 to a positive supply voltage +VCC. The emitter of the phototransistor 15 is connected to the ground by means of a resistor 19.

The reference numeral 20 indicates a two-input amplifier having a first positive input directly connected to the collector of the phototransistor 15, and a second negative input is connected to a terminal 21 which is connected to the positive power supply +VCC by means of a resistor 23, and is connected to the ground by means of a resistor 24 which is equal in value to the resistor 23. The resistors 23 and 24 constitute therefore a voltage divider which determines a voltage on the terminal 21 which is approximately half the voltage existing on the positive pole +VCC.

The output of the amplifier 20 is connected to a first (positive) input of a two-input amplifier 26 which constitutes a voltage-current converter the ouput whereof is connected to the base of an NPN transistor 27 which acts as power amplifier.

The collector of the transistor 27 is directly connected to the positive power supply +VCC and its emitter is connected to a second (negative) input of the amplifier 26 and to the anode of the photodiode 14, the cathode whereof is connected to the ground by means of a resistor 28 and a block 29 which provides an output signal I which is proportional to the current which flows through the photodiode 14.

Said signal I is sent to discriminating means comprising two comparators 31 and 32. More precisely, said signal I reaches the positive input of the comparator 31 and the negative input of the comparator 32. At the negative input of the comparator 31 there is a signal I1 determined by means of a potentiometer 33, and at the positive input of the comparator 32 there is a signal I2 determined by means of a potentiometer 34. The value of the signal I2 is higher than the value of the signal I1, and they are set as limits of the range of values which the signal I can assume in conditions of normal feed of the strip 2. Said comparators 31 and 32 therefore constitute, as a whole, a window comparator group. The output of the comparator 31 is connected to a terminal 36, while the output of the comparator 32 is directly connected to a terminal 37 and to a terminal 38 through a block 39 which provides a signal in output when the signal at its input persists longer than a preset time. Said terminals 36, 37 and 38 are connected to an alarm indicator block 41.

The operation of the checking device 13 according to the present invention is as follows.

Considering the apparatus 1 during the normal feed of the strip 2 to the cigarette manufacturing machine 4, the checking device 13, with the strip 2 between the phototransistor 15 and the photodiode 14, is calibrated by adjusting the potentiometer 18 so as to have a set voltage VP on the collector of the phototransistor 15; the value of said voltage VP is substantially intermediate between the value of the saturation voltage VS and the value of the switch-off voltage VI and is in particular proximate to the value of the voltage at the node 21.

In this manner the phototransistor 15 operates in a linear manner, with the output voltage signal VP on the collector being proportional to the amount of light detected by the phototransistor itself. For this collector voltage value VP there is a current, as a function of the amplification coefficents of the amplifiers 20 and 26 and of the transistor 27, which flows through the photodiode 14 so that the derived current I is intermediate between the two current values I1 and I2 respectively present at the two complementary inputs of the comparators 31 and 32. Consequently there is a signal with a logical level 1 at both output terminals 36 and 37, so that the alarm block 41 and the block 39 are not activated.

Assume now that there is an interruption in the passage of the strip 2 between the phototransistor 15 and the photodiode 14, e.g. due to a breakage of the strip 2 or to the absence of said strip for any reason (e.g. the reel 3 has emptied and the device 43 has not spliced the strip of the reel 3'). This produces an increase in the intensity of the light which reaches the phototransistor 15 and a corresponding increase in the emitter-collector current; this causes therefore a decrease in the voltage VP present at the positive input of the amplifier 20. A decrease in the current which flows through the photodiode 14 is obtained through the amplifiers 20 and 26 and the transistor 27; this is equivalent to a decrease in the intensity of the light which reaches the phototransistor 15 so as to increase the voltage on the collector of the phototransistor 15 towards the normal operating value VP, i.e. in the proportional operating range.

The decrease in the current flowing through the photodiode 14 determines a reduction in the current I, so as to drop below the value I1, so that the signal at the output of the comparator 31 changes state; said comparator determines a visual or acoustic signal capable of attracting the attention of an operator by means of the block 41, and said operator can restore the correct conditions for the feed of the strip 2.

Secondly, assume that due to a splicing (performed by means of the known device 43) between the end portion of a strip 2 unwound from an almost empty reel 3 and the initial portion of a new reel 3' a portion of strip with double thickness runs between the phototransistor 15 and the photodiode 14. This causes a decrease in the intensity of the light received by the phototransistor 15 and a corresponding decrease in the related emitter-collector current.

In this situation, the voltage present at the positive input of the amplifier 20 increases, so that, the current flowing through the photodiode 14 increases. This is equivalent to an increase in the intensity of the light received by the phototransistor 15, and consequently to a decrease in the voltage on the collector of the phototransistor 15 towards the normal operating value VP.

The increase in the current flowing through the photodiode 14 determines an increase in the current I which is greater than the value of the signal I2, so that the signal at the output of the comparator 32 changes state and a signal indicating the anomaly is fed to the block 41 through the terminal 37 and allows e.g. to discard said portion of douoble-thickness strip 2 in the manufacturing machine 4. If the portion with double thickness is too long, then the indication signal at the output of the comparator 32 persists longer than a preset limit value and is detected by the block 39, which provides the block 41 with a signal for a consequent alarm, which provides the block 41 with a signal for a consequent alarm. Said alarm signal furthermore occurs if, due to any circuit malfunction of the device 13, the anomaly signal of the comparator 32 is stably present.

The advantages obtained with the checking device according to the present invention are evident from what has been described.

In particular the detection of various anomaly conditions of the strip feed is achieved with a single pair of light-emitting and light-detecting elements by virtue of the fact that the light-detecting element does not operate in saturation or switched off conditions but operates in a linear manner with the output signal being proportional to the amount of detected light. This also determines high sensitivity of the checking functions, which is also increased by the fact that the anomaly detection is not performed by directly detecting the output signal of the light-detecting element but by means of a final element of an amplifier unit which particularly checks the light-emitting element in negative feedback.

The block 39 furthermore performs auto-diagnostics functions for the functionality of the device 13.

Finally, it is evident that the described and illustrated embodiment of the control device according to the present invention is susceptible to modifications and variations without abandoning the scope of the inventive concept.

For example, the photodiode 14 and the phototransistor 15 may be replaced with functionally equivalent elements.

We claim:

1. A device for checking feed conditions of a continuous strip of wrapping material, comprising an optoelectronic device including a light-emitting means and a light-detecting means, arranged on opposite sides of said continuous strip, a negative feedback circuit means connected between said light detecting means and said light emitting means for causing said optoelectronic device to operate in a linear manner, current detecting means connected in series with said light emitting means and generating an output signal correlated to a current flowing through said light emitting means, and means for detecting interruptions and thickened portions of the continuous strip according to the amplitude of said output signal, said means for detecting being connected to said current detecting means and receiving said output signal therefrom.

2. A device according to claim 1, wherein said means for detecting comprises means for comparing said output signal to at least two reference signals.

3. A device acording to claim 2, wherein said means for detecting further comprises delay means for detecting the presence of thickened portions of the continuous strip for longer than a preset time and alarm devices.

4. A device according to claim 1, wherein said means for detecting comprises at least one window comparator.

5. A device according to claim 1, wherein said negative feedback circuit means comprises an amplifier means connected to said light detecting means and generating an amplified signal, and driver means connected between said amplifier means and said light emitting means, said driver means receiving said amplified signal and generating a corresponding driving signal for said light emitting means.

6. A device according to claim 5, wherein said light emitting means is a photodiode having an anode and said light detecting means is a phototransistor having emitter and collector terminals each connected to a respective one of two reference potential lines through respective resistor means, said amplifier means including a two input amplifier having a positive input connected to said collector terminal of said phototransistor, a negative input connected to a reference voltage signal and an output connected to said driver means, said driver means including a voltage-current converter and a power amplifier transistor, said voltage-current converter having a converter input connected to said output of said two input amplifier and a converter output and said power amplifier transistor having a base terminal connected to said converter output, a collector terminal connected to one of said reference potential lines and an emitter terminal connected to said anode of said photodiode.

7. A device according to claim 6, wherein at least one of said respective resistor means comprise a variable resistor and said negative input of said two input amplifier is connected to the intermediate tap of a resistive voltage divider connected between said two reference potential lines.

8. A device for checking feed conditions of a continuous strip of wrapping material, comprising:

an optoelectronic device including a photodiode having a cathode and an anode and a phototransistor having emitter and collector terminals, said photodiode and phototransistor being arranged on opposite sides of said continuous strip and being each connected to a respective one of two reference potential lines through respective resistor means;

a negative feedback circuit means controlling said optoelectronic device to operate in a linear manner, said negative feedback circuit means comprising a two input amplifier, a voltage-current converter and a power amplifier transistor, said two-input amplifier having a positive input connected to said collector terminal of said phototransistor, a negative input connected to a reference voltage signal and an output, said voltage-current converter having a converter input connected to said output of said two input amplifier and a converter output and said power amplifier transistor having a base terminal connected to said converter output, a collector terminal connected to one of said reference potential lines and an emitter terminal connected to said anode of said photodiode;

current detecting means connected in series with said photodiode and generating an output signal correlated to a current flowing through said photodiode, and means for detecting interruptions and thickened portions of the continuous strip according to the amplitude of said output signal, said means for detecting being connected to said current detecting means and comprising means for comparing said output signal to at least two reference signals.

9. In a cigarette manufacturing machine, an apparatus for feeding a continuous strip of cigarette paper comprising, cascade coupled to each other: at least two feed reels feeding strips of cigarette paper; a strip splicing device, for splicing said strips of cigarette paper into a continuous strip; a feed condition checking device, for detecting interruptions and thickened portions of said continuous strip; a cigarette wrapping device and blade means for cutting individual cigarettes, said feed condition checking device comprising an optoelectronic device including a light-emitting means and a light-detecting means, arranged on opposite sides of said continuous strip, a negative feedback circuit means connected between said light detecting means and said light emitting means for causing said optoelectronic device to operate in a linear manner, current detecting means connected in series with said light emitting means and generating an output signal correlated to a current flowing through said light emitting means, and means for detecting interruptions and thickened portions of the continuous strip according to the amplitude of said output signal.

* * * * *